US008844615B2

(12) United States Patent
Luharuka et al.

(10) Patent No.: US 8,844,615 B2
(45) Date of Patent: Sep. 30, 2014

(54) OILFIELD MATERIAL DELIVERY MECHANISM

(75) Inventors: Rajesh Luharuka, Stafford, TX (US); Rod Shampine, Houston, TX (US); Joe Hubenschmidt, Sugar Land, TX (US); Philippe Gambier, Houston, TX (US); Brian Ochoa, Houston, TX (US); Thomas Allan, Houston, TX (US); Michael D. Parris, Richmond, TX (US); Jean-Louis Pessin, Houston, TX (US); Edward Leugemors, Sugar Land, TX (US); Alejandro J. Martinez, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/771,789

(22) Filed: Jun. 29, 2007

(65) Prior Publication Data

US 2008/0066911 A1 Mar. 20, 2008

Related U.S. Application Data

(60) Provisional application No. 60/825,815, filed on Sep. 15, 2006, provisional application No. 60/889,684, filed on Feb. 13, 2007.

(51) Int. Cl.
*E21B 27/00* (2006.01)
*B65G 53/00* (2006.01)
*E21B 43/267* (2006.01)

(52) U.S. Cl.
CPC ..... *E21B 43/267* (2013.01)
USPC ..... 166/75.11; 166/90.1; 166/305.1; 166/270.1; 166/271; 222/137; 406/74

(58) Field of Classification Search
USPC ..... 166/75.11, 75.15, 90.1, 84.1, 105, 68.5, 166/68, 308.2, 162.1; 417/252, 435; 406/62–68, 74, 76, 117–120; 222/137
See application file for complete search history.

(56) References Cited

U.S. PATENT DOCUMENTS 3,146,477 A * 9/1964 Bergman et al. ..... 15/104.062
3,197,261 A * 7/1965 Kauffman ..... 406/124
3,210,131 A * 10/1965 Booth et al. ..... 406/136

(Continued)

FOREIGN PATENT DOCUMENTS

DE 2737373 3/1979
EP 0776843 6/1997

(Continued)

*Primary Examiner* — James Sayre
(74) *Attorney, Agent, or Firm* — Rachel E. Greene; Tim Curington

(57) ABSTRACT

A mechanism for pressurized delivery of material into a well without exposure to a high pressure pump. The mechanism may include material delivery equipment that is coupled to the high pressure pump or other pressure inducing equipment through a material carrier that intersects a fluid line from the pump. The material carrier may include chambers that are reciprocated or rotated between positions that are isolated from the fluid line and in communication with the fluid line. While isolated from the fluid line, the chambers may be filled with oilfield material which may then be delivered to the fluid line when positioned in communication therewith. In this manner, a supply of the oilfield material may be retained in a substantially isolated state relative to the pump and components thereof which may be susceptible to damage from exposure to the oilfield material.

29 Claims, 8 Drawing Sheets

(56) References Cited

U.S. PATENT DOCUMENTS

| | | | | | |
|---|---|---|---|---|---|
| 3,281,022 | A | * | 10/1966 | De Jarnett | 406/74 |
| 3,560,053 | A | | 2/1971 | Ortloff | |
| 3,586,129 | A | * | 6/1971 | Cass | 184/7.2 |
| 4,150,759 | A | * | 4/1979 | Bell, Jr. | 414/187 |
| 4,305,531 | A | * | 12/1981 | Dooley et al. | 222/334 |
| 4,376,600 | A | * | 3/1983 | Egli | 406/63 |
| 4,410,106 | A | * | 10/1983 | Kierbow et al. | 222/135 |
| 4,614,435 | A | | 9/1986 | McIntire | |
| 4,671,665 | A | | 6/1987 | McIntire | |
| 4,808,004 | A | | 2/1989 | McIntire et al. | |
| 5,775,852 | A | * | 7/1998 | Boutte et al. | 406/32 |
| 5,908,267 | A | | 6/1999 | Schuring et al. | |
| 6,056,058 | A | * | 5/2000 | Gonzalez | 166/310 |
| 7,793,741 | B2 | * | 9/2010 | Harder et al. | 175/67 |
| 2002/0110427 | A1 | * | 8/2002 | Waddell | 406/51 |
| 2005/0006089 | A1 | * | 1/2005 | Justus et al. | 166/250.01 |
| 2005/0056428 | A1 | | 3/2005 | Jeffrey, Jr. | |
| 2006/0289166 | A1 | * | 12/2006 | Stromquist et al. | 166/305.1 |
| 2007/0277982 | A1 | * | 12/2007 | Shampine et al. | 166/308.1 |

FOREIGN PATENT DOCUMENTS

| | | | |
|---|---|---|---|
| GB | 816013 | * | 7/1959 |
| RU | 1800063 | A1 | 3/1993 |
| SU | 153464 | | 6/1963 |

* cited by examiner

OILFIELD MATERIAL DELIVERY MECHANISM

CROSS REFERENCE TO RELATED APPLICATION(S)

This application claims priority under 35 U.S.C. §119(e) to U.S. Provisional Application Ser. No. 60/825,815, entitled Proppant Injection into a High Pressure Line, filed on Sep. 15, 2006 and to U.S. Provisional Application Ser. No. 60/889,684 entitled Solid Injection into a High Pressure Line, filed on Feb. 13, 2007, both of which are incorporated herein by reference.

FIELD OF THE INVENTION

Embodiments described relate to systems and methods for delivering an oilfield material to a well at an oilfield. In particular, embodiments of oilfield material delivery systems and mechanisms are described for delivering oilfield material without exposure of the oilfield material to pressure inducing equipment that might otherwise be susceptible to damage by the exposure.

BACKGROUND OF THE RELATED ART

Large oilfield operations generally employ any of a variety of positive displacement or other fluid delivering pumps. Such pumps may be employed in applications for accessing underground hydrocarbons. These applications may include cementing, water jet cutting, and hydraulic fracturing of underground rock to name a few.

A positive displacement pump may be a fairly massive piece of equipment with associated engine, transmission, crankshaft and other parts, operating at between about 200 Hp and about 4,000 Hp. A large plunger is driven by the crankshaft toward and away from a chamber in the pump to dramatically effect a high or low pressure thereat. This makes it a good choice for high pressure applications. Indeed, where fluid pressure exceeding a few thousand pounds per square inch (PSI) is to be generated, a positive displacement pump is generally employed. Hydraulic fracturing of underground rock, for example, often takes place at pressures of 10,000 to 20,000 PSI or more to direct an oilfield fluid and material through an underground well to release oil and gas from rock pores for extraction.

When employing oilfield pumps, regular pump monitoring and maintenance may be sought to help ensure uptime and increase efficiency of operations. That is, like any other form of industrial equipment a pump is susceptible to natural wear that could affect uptime or efficiency. This may be of considerable significance in the case of pumps for large scale oilfield operations as they are often employed at the production site on a near round the clock basis and may operate under considerably harsh protocols. For example, in the case of hydraulic fracturing applications, a positive displacement pump may be employed at the production site and intended to operate for six to twelve hours per day for more than a week generating extremely high pressures throughout. Thus, wear on pump components during such an operation may present in a variety of forms.

In particular, internal valve seals of the pump are prone to failure, especially where abrasive oilfield material is directed through the pump during a fracturing application as described. These internal valve seals may be of a conformable material in order to allow proper sealing even where the abrasive "proppant" material is present at a sealing interface of the valve. However, the conformable nature of the seal may leave it susceptible to deterioration by this same abrasive oilfield material. Additionally, other components of the pump such as the normally smooth surfaced pumping chamber at the output side of the valves seals may be susceptible to wear by abrasives that are pumped through the pump. Such deterioration of pump components may significantly compromise control over the output of the pump and ultimately even render the pump ineffective.

In order to address pump component deterioration as described, techniques have been developed to monitor acoustics of the pump that present during operation. For example, issues with wearing pump components such as the noted valve seals may be accompanied by certain vibrations particular to the type of wear taking place. Thus, an acoustic sensor may be coupled to the pump to detect high-frequency vibrations particular to a leak or incomplete seal within the chamber of the pump. Such a leak is a common precursor to pump failure. Unfortunately, acoustic detection of leaks or other pump anomalies may only take place once some degree of damage has taken place. That is, acoustic detection of pump problems fails to avoid problem occurrences in a literal sense, but rather only indicates the condition of such problems. Thus, at best there remains the need to take a detected malfunctioning pump out of the operation.

In addition to pump monitoring as described above, efforts have been made to actually prevent pump damage by pumped abrasives. That is, rather than waiting for a minor degree of pump damage to acoustically present as indicated above, efforts have been made to avoid damage to certain pump components altogether. These efforts include introducing abrasives, such as the above described proppant, at locations subsequent to the pressure producing valves and other particularly susceptible oilfield pump components. For example, as detailed in U.S. Pat. No. 3,560,053 to Ortloff, a pressurized abrasive slurry may be introduced to an oilfield fluid after the oilfield fluid has been directed from an oilfield pump. In this manner, the oilfield pump may be spared exposure to the potentially damaging abrasive slurry.

Unfortunately, the above described technique of sparing oilfield pump components exposure to the abrasive slurry is achieved by the addition of a significant amount of equipment at the oilfield. Indeed this added equipment may require its own monitoring and maintenance due to exposure to the abrasive slurry. For example, mixing and blending equipment along with pressurization equipment, including susceptible valving, may be required apart from the primary oilfield pumps described above. Thus, while the original pumps may be spared exposure to abrasives, another set of sophisticated equipment remains exposed, requiring its own degree of monitoring and maintenance.

SUMMARY

A method is disclosed for delivering a material into a high pressure fluid flow at an oilfield. The method includes filling a chamber with the material from a material supply while in a first position. The chamber may then be shifted into a second position that is exposed to the high pressure fluid flow to the substantial exclusion of the material supply.

DETAILED DESCRIPTION

Embodiments are described with reference to the delivery of oilfield material in the form of proppant for a fracturing operation. However, other types of operations, such as cementing and water jet cutting, may realize the benefits of material delivery embodiments detailed herein. Regardless, embodiments described herein include techniques for delivering potentially harmful oilfield material relative to pressurization equipment to a well at an oilfield without subjecting the equipment to the material in any significant manner.

Figure 1:
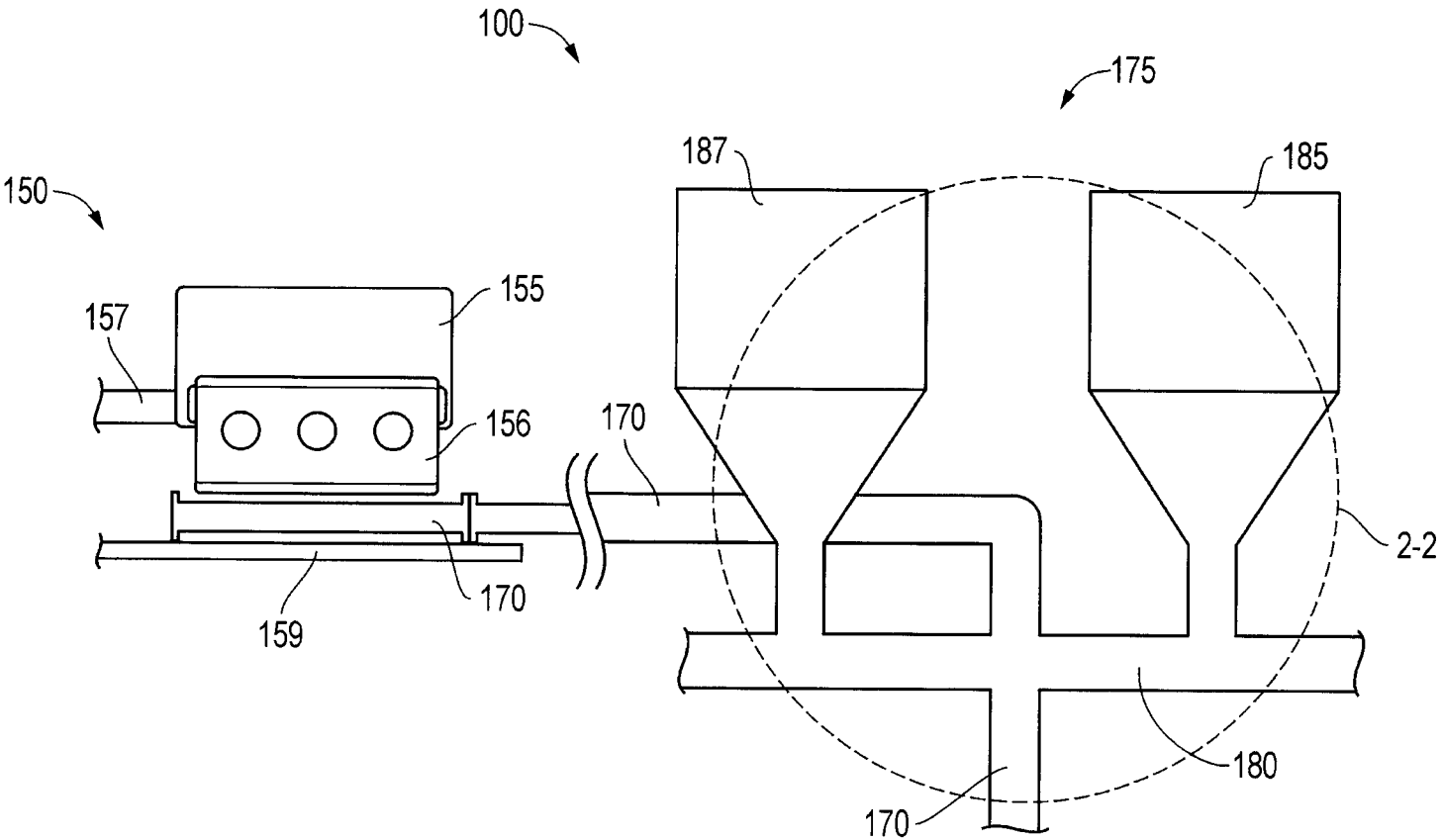
FIG. 1 is an overview of an embodiment of an oilfield material delivery mechanism.

Referring specifically now to FIG. 1, an embodiment of an oilfield material delivery mechanism 100 is depicted. The oilfield material delivery mechanism 100 is made up primarily of pressure inducing equipment 150, such as the triplex pump shown, and material supply equipment 175. As detailed below, the material supply equipment 175 is linked to the pressure inducing equipment 150 for delivery of oilfield material 275 into a well 320 at an oilfield 301 (see FIGS. 2A-2C and FIG. 3).

As shown in FIG. 1, the pressure inducing equipment 150 includes a positive displacement triplex pump atop a skid 159. The pump includes a conventional crankshaft 155 that is powered by a driveline 157 to generate pumping of an oilfield fluid from a fluid end 156 of the pump and through a fluid line 170 toward the material supply equipment 175 and ultimately to the noted well 320 (see FIG. 3). More specifically, the pressurization of the oilfield fluid may be a result of coordinated reciprocation of plungers and striking of sealing valves of the fluid end 156 to generate pressures of up to about 20,000 PSI, for employment in a fracturing application. Alternatively, other degrees of pressurization may be achieved for other applications. For example, where the pump is to be employed in a cementing application, up to about 5,000 PSI may be generated. Additionally, embodiments of the pump may be employed for water jet cutting applications. Furthermore, while a single positive displacement triplex pump is depicted, a variety of pump types and arrangements may be selected to serve as pressure inducing equipment 150.

Figure 2A:
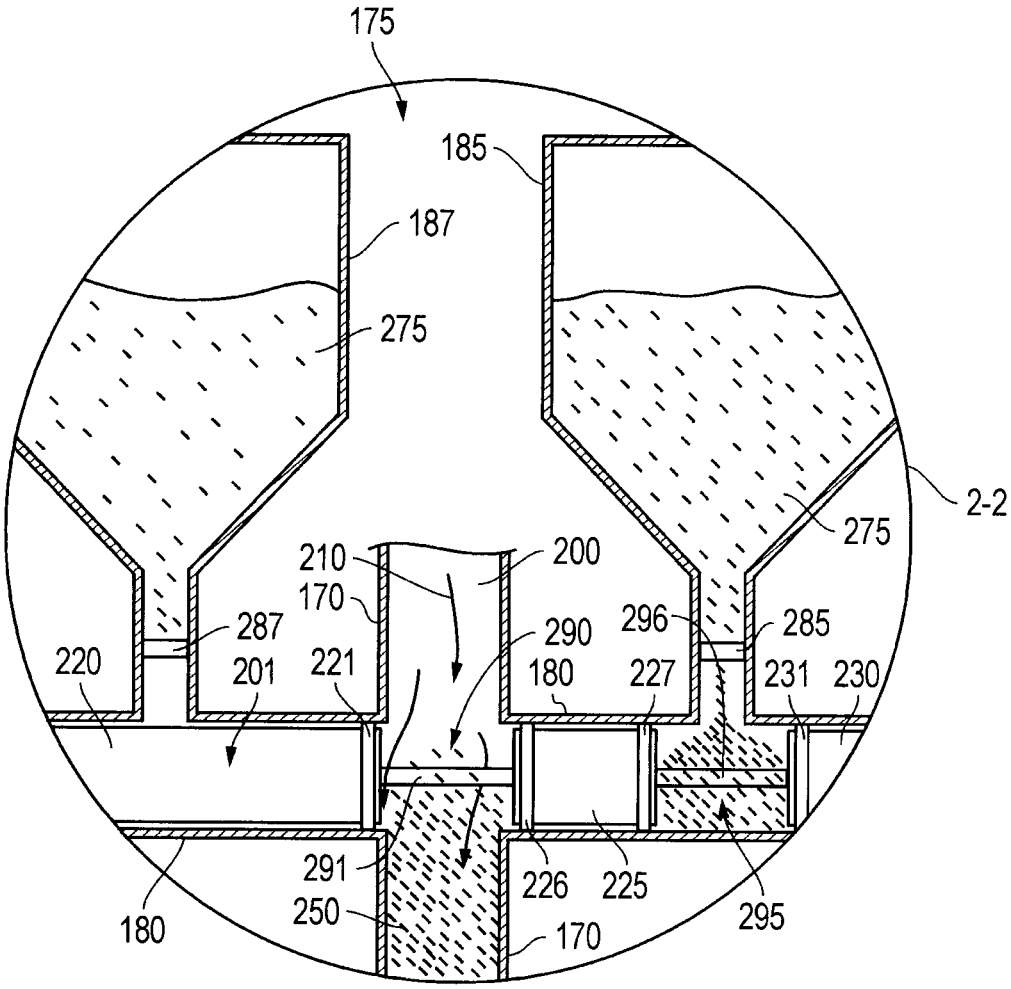
FIG. 2A is an enlarged cross sectional view of material supply equipment of the oilfield material delivery mechanism of FIG. 1.
Figure 2B:
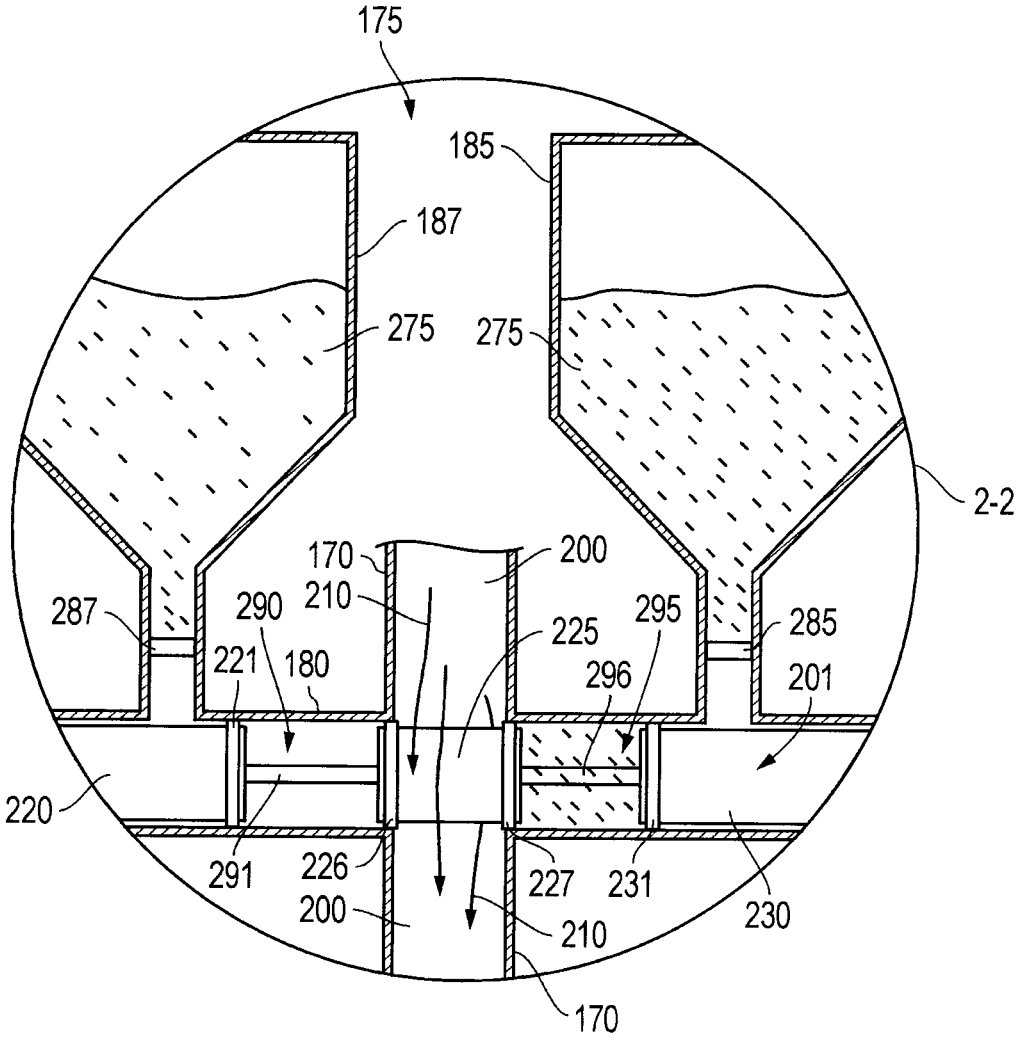
FIG. 2B is a view of the material supply equipment with a material carrier therein shifted from the position of FIG. 2A.
Figure 2C:
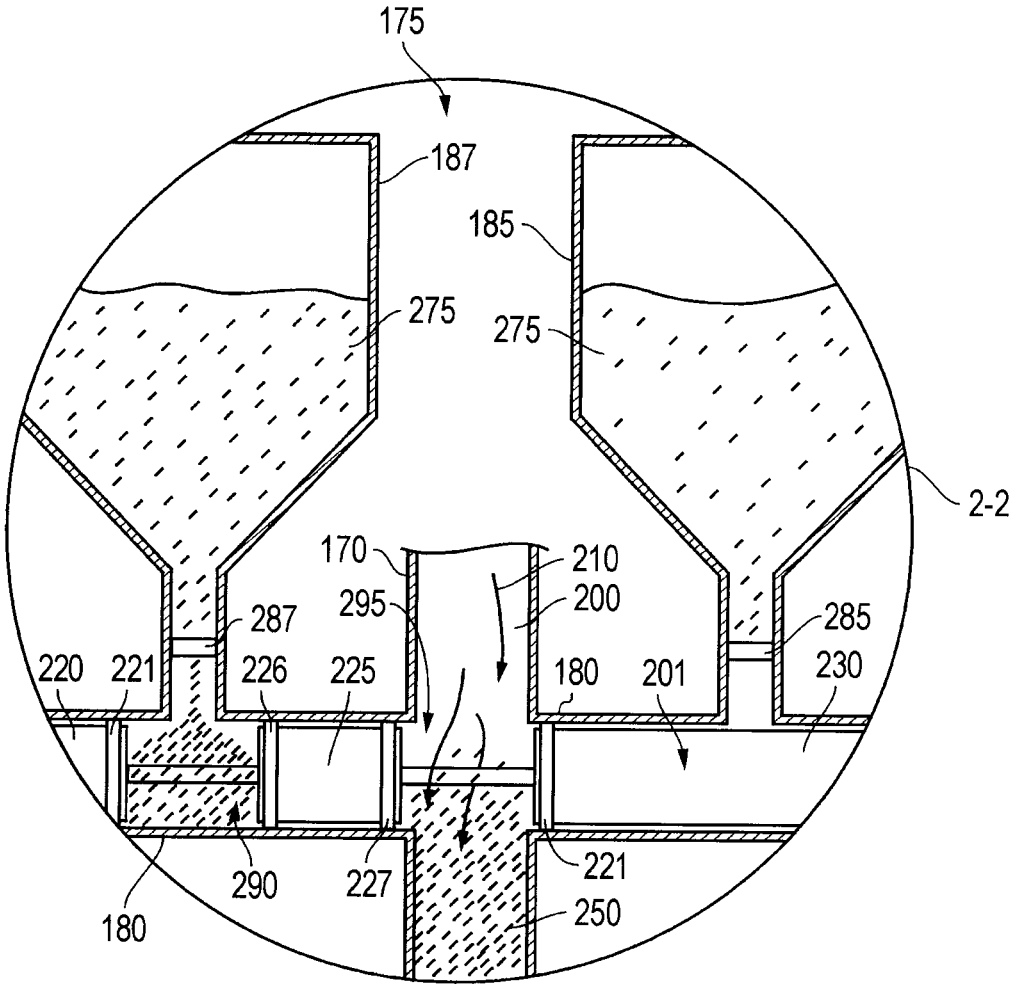
FIG. 2C is a view of the material supply equipment with the material carrier therein shifted from the position of FIG. 2B.

Continuing with reference to FIG. 1, with added reference to FIGS. 2A-2C, the material supply equipment 175 of the oilfield material delivery mechanism 100 is shown linked to the pressure inducing equipment 150 through the fluid line 170 as indicated above. In particular, a material carrier housing 180 of the material supply equipment 175 is shown intersecting the fluid line 170. As detailed below, the material carrier housing 180 includes a material carrier 201 disposed therein for acquiring oilfield material 275 from reservoirs 185, 187. For a fracturing operation, the oilfield material 275 may include a proppant such as sand, ceramic material or a bauxite mixture. Additionally, other abrasives or potentially caustic materials may be employed for a variety of other applications such as a cement slurry for cementing. With this in mind, the material carrier 201 is configured to deliver the oilfield material 275 to the oilfield fluid flow within the fluid line 170 in a synchronized and isolated manner. Thus, the pressure inducing equipment 150, including for example, pump components of the fluid end 156 that might be susceptible to damage upon exposure to the oilfield material, may substantially avoid such exposure.

Continuing now with reference to FIGS. 2A-2C a slightly enlarged cross-sectional view of the material supply equipment 175 is depicted, taken from 2-2 of FIG. 1. The above noted fluid flow (arrows 210) is shown directed through the fluid line 170 from the direction of the pressure inducing equipment 150 of FIG. 1. The fluid flow 210 is substantially 'clean' prior to its intersection of the material carrier 201 and its housing 180. That is, the oilfield fluid, which may be primarily water or other appropriate fluid for transporting oilfield material 275, has yet to encounter any oilfield material 275 at this point, and is thus, referenced as 'clean' or substantially free of oilfield material contamination. In fact, the interior of the fluid line 170 prior to the indicated intersection is referenced herein as a clean region 200 of the line 170. Alternatively, however, once the fluid flow 210 traverses the material carrier 201 it may become 'dirty', depending on the position of the material carrier 201 as detailed further below. For example, as shown in FIG. 2A, the material carrier 201 is positioned such that the oilfield fluid encounters oilfield material 275 upon its arrival at the noted intersection with the material carrier 201. Thus, the addition of oilfield material 275 to the fluid flow 210 may leave the oilfield fluid 'dirty' at this point. Therefore, the interior of the fluid line 170 below the indicated intersection may be referenced herein as a dirty region 250 of the line 170 at times. Of note is the fact that with multiple reservoirs 185, 187, multiple oilfield materials 275 may be independently delivered to the fluid flow 210.

Continuing with reference to FIG. 2A, the material carrier 201 delivers oilfield material 275 to the fluid flow 210 depending upon the particular position it occupies within the material carrier housing 180. For example, oilfield material 275 is delivered to the fluid flow 210 from a first chamber 290 in the material carrier 201 to provide the dirty oilfield fluid as noted above. However, in the position shown in FIG. 2A, a second chamber 295 in the material carrier 201 is positioned below the second reservoir 185 for obtaining oilfield material 275 therefrom. Thus, while the contents of the first chamber 290 are emptying into the fluid flow 210 to dirty the oilfield fluid, a second chamber 295 is already being filled with more oilfield material 275 for delivery to the fluid flow 210 at a later time as detailed with reference to FIG. 2C below.

In the position of FIG. 2A, the second chamber 295 is aligned with the second reservoir 185 for receipt of oilfield material 275 as indicated. The oilfield material 275 is provided to the second chamber 295 through a second reservoir valve 285 that is in an open position when the second chamber 295 resides therebelow as shown. However, at this same time a first reservoir valve 287 within the first reservoir 187 is closed. The closed position of the first reservoir valve 287 corresponds with the lack of a chamber (e.g. 290) therebelow to fill with oilfield material 275. Thus, the outer surfaces of the material carrier 201 are left substantially unexposed to the potentially abrasive oilfield material 275. This may help avoid any significant build-up of oilfield material 275 between the outer surfaces of the material carrier 201 and its housing 180 in order to promote the continued fluid movement of the material carrier 201 as described below. Opening and closing of the reservoir valves 285, 287 in this synchronized manner may be achieved by a conventional feedback mechanism. For example, a proximity switch may be coupled to the material carrier 201 that allows detection of chamber positioning during carrier movement within the housing 180. Such detection information may be employed to control opening and closing of the valves 285, 287 in an automated manner.

As indicated, the material carrier 201 is configured with chambers 290, 295 for receiving oilfield material 275 from the reservoirs 187 and 185 and subsequent delivery to the fluid flow 210. In the embodiment shown, the material carrier 201 is reciprocated similar to a piston or a plunger within the material carrier housing 180 in order to shift the positions of the chambers 290, 295 in receiving and delivering of the oilfield material 275 as indicated. In fact, the material carrier 201 may be coupled to reciprocating equipment such as a conventional crankshaft or other driving means in order to achieve the desired movement of the carrier 201. For example, a first carrier portion 220 or a second carrier portion 230 may extend beyond the carrier housing 180 and to driving means for reciprocation of the entire material carrier 201.

The material carrier 201 includes the first and second carrier portions 220, 230 as noted above. However, a center carrier portion 225 is disposed between the first and second carrier portions 220, 230 in order to help define the noted chambers 290, 295. So, for example, as shown in FIG. 2A, a second separator 296 is positioned between the second carrier portion 230 and the center carrier portion 225 substantially defining a width of the second chamber 295. In the position shown, the circumferential boundary of the second chamber 295 is substantially defined by the housing 180. Regardless, the second separator 296 is of a fairly minimal profile. Similarly, a first separator 291 is positioned between the first carrier portion 220 and the center carrier portion 225 to define the width of the first chamber 290. However, in the position shown, the circumferential boundary of the housing 180 has been eliminated such that the oilfield material 275 is taken away by the fluid flow 210 as described above.

As indicated above, at the time each chamber 290, 295 is filled with oilfield material 275, it is defined circumferentially by the housing 180 with the exception of the interface of the housing 180 and the reservoir 185, 187. Width-wise each of the chambers 290, 295 are also defined substantially by the center carrier portion 225 and one of the first and second carrier portions 220, 230. However, to ensure that any oilfield material 275 within the housing 180 is substantially confined to the chambers 290, 295 width-wise, a series of carrier seals 221, 226, 227, 231 are provided at particular locations about the material carrier 201. So, for example, the second chamber 295 is defined width-wise primarily by the center carrier portion 225 and the second carrier portion 230 as indicated. However, a second center seal 227 and a second carrier seal 231 are provided about the center carrier portion 225 and the second carrier portion 230, respectively, to help ensure material 275 within the second chamber 295 remains therein until the exposed to the fluid flow 210 as described above. Similarly, the first chamber 290 is defined to a degree width-wise by a first carrier seal 221 and a first center seal 226 to ensure that material 275 in the first chamber remains therebetween until exposure to the fluid flow 210 as depicted in FIG. 2A.

The above noted seals 221, 226, 227, 231 may be of a variety of materials including ceramics, polymer based conformable configurations and others. In one embodiment, the seals 221, 226, 227, 231 may even be grease seals that are supplied under high pressure into the housing 180, with grease delivery synchronized in accordance with the positioning of the material carrier 201. Additionally, the separate seals 226, 227 of the center carrier portion 225 may be a single seal, grease or otherwise, running substantially the entire width of this portion 225. Furthermore, the width of the seals may vary, or even the number of seals along the carrier 201 in order to help ensure adequate isolation of the chambers 290, 295 during reciprocation. Furthermore, a seal-less spool-type piston may be employed with a certain degree of tolerable leak.

Regardless, of the particular type of material or configuration selected, it is worth noting that the exposure of the seals 221, 226, 227, 231 to the potentially abrasive oilfield material 275 is limited to retaining of the material 275 as the position of a given chamber 290, 295 is shifted. That is, unlike seals within a conventional triplex fracturing pump, the seals 221, 226, 227, 231 described herein are not subjected to striking valves within a high pressure environment with abrasive materials likely being driven thereinto on a frequent basis. Rather, the seals 221, 226, 227, 231 described herein are spared such harsh conditions and may last ten times or more longer than a conventional seal of a triplex fracturing pump.

As depicted in FIGS. 2A-2C, the technique of oilfield material 275 delivery employed, may take advantage of the orientation of the reservoirs 185, 187, allowing gravity and an open valve 285, 287 to direct oilfield material 275 into the chambers 290, 295. However, in another embodiment, the reservoirs 185, 187 may be pressurized by conventional means with an inert gas or other fluid in order to more actively and readily fill a given chamber 290, 295 with oilfield material 275. This pressurization may serve as a tool to aid in the timing and synchronization of the filling in light of the potential rate of reciprocating of the overall material supply equipment 175 system. However, even in circumstances where the reservoirs 185, 187 are pressurized, it is worth noting that the valves 285, 287 may be spared significant damage by the potentially abrasive oilfield material 275. That is, similar to the seals 221, 226, 227, 231 noted above, the valves 285, 287 are unlikely to include a conformable material subjected to repeated striking with abrasive materials likely being driven thereinto on a frequent basis. In fact, given that the nature of the valves 285, 287 is to merely open and close at the appropriate times, the configuration of the valves 285, 287 may be quite robust, non-conformable, and of stainless steel or other durable construction.

Continuing with reference to FIG. 2B, with added reference to 2A, the material carrier 201 is shown shifting in position, with the center carrier portion 225 disposed within the fluid line 170. However, the fluid flow 210 is also depicted as continuing around the center carrier portion 225 and toward the well 320 of FIG. 3. That is, in the embodiment shown, the presence of the material carrier 201 within the fluid line 170 fails to occlude the line 170. For example, the diameter of the fluid line 170 may be larger than that of the carrier housing 180, thereby allowing the flow of fluid to continue substantially undisturbed toward the well of FIG. 3 as indicated.

Additionally, regardless of the exact position of the material carrier 201, it is constantly being washed by the fluid flow 210. So, for example, in the position of FIG. 2A, the first chamber 290 is being emptied of oilfield material 275 into the ever present fluid flow 210. However, at this time, the first separator 291 of the material carrier 201 is being washed by incoming clean fluid of the fluid flow 210. In fact, perhaps of greater significance, the seals 221, 226 adjacent the first chamber 290 are also being washed by clean fluid of the fluid flow 210. Such a wash of these seals begins as the first carrier seal 221 enters the fluid line 170, continues as the first chamber 290 is emptied as depicted in FIG. 2A, and eventually ceases as the fluid flow 210 is cut off from access to the first center seal 226 by the second center seal 227, thus completing its travel across the fluid line 170 (e.g. as shown in FIG. 2C). Washing of the seals 221, 226, 227, 231, and the material carrier 201 generally, as described helps to avoid prolonged exposure or build-up of the potentially abrasive and/or damaging oilfield material 275 anywhere within the carrier housing 180. Thus, the life of the various parts of the material carrier 201, especially the seals 221, 226, 227, 231, may be substantially extended. In one embodiment in particular, the seals 221, 226, 227, 231 are of ceramic construction for washing by a fluid flow 210 of water. However other seal material may be employed as described above. Additionally, a supercritical fluid or liquefied gas may be employed as the oilfield fluid, enhancing effectiveness of the washing of the seals 221, 226, 227, 231 and the carrier 201 generally.

Continuing with reference to FIG. 2B, the above noted shift of the material carrier 201, to the left in the depiction, is shown. The center carrier portion 225 occupies space within the fluid line 170 as the fluid flow 210 washes theraround as detailed above. At this time, oilfield material 275 that was contained within the first chamber 290 has all been washed away with the passing fluid flow 210. In fact, in the depiction of FIG. 2B, the clean region 200 of the fluid line 170 now extends below the material carrier 201. At this time, the now empty first chamber 290 is headed toward alignment with the first reservoir 187 as the recently filled second chamber heads toward alignment with the fluid line 170 so that the delivery process may continue as described below.

Referring now to FIG. 2C, with added reference to FIG. 1, the progression of the reciprocating material carrier 201 to the left of the depiction leaves the first chamber 290 in alignment with the first reservoir 187. Thus, as detailed above with reference to the filling of the second chamber 295, the first chamber 290 is now filled with oilfield material 275 from the first reservoir 187. At this same time, the second chamber 295 traverses the fluid line 170 allowing the fluid flow 210 to carry away the oilfield material 275 once stored therein. Thus, the dirty region 250 of the fluid line 170 reappears immediately below the material carrier 201. However, the 'dirty' contaminants of the oilfield material 275 continue to be found in significant amounts only below the material carrier 201 to the exclusion of areas therabove in the fluid line 170 in the direction of the pressure inducing equipment 150. Thus, the pressure inducing equipment 150 is spared significant exposure to the oilfield material 275 that might otherwise enhance the rate of fatigue on the equipment 150.

In addition to minimizing potentially damaging exposure of oilfield material 275 to susceptible equipment components, the above described technique of material 275 delivery may be achieved in a continuous and uninterrupted manner. For example, as described, the material carrier 201 is a reciprocating feature of the material supply equipment 175. The carrier 201 need not stop movement in order to obtain or deliver oilfield material 275 to the fluid line 170. Thus, a reliable rate of oilfield material 275 delivery to the fluid line 170 may be achieved. Furthermore, in one embodiment, the fluid line 170 may be coupled to multiple material supply equipment 175 assemblies. In this manner, a timed synchronization between such assemblies and reciprocating material carriers thereof may be utilized to ensure that a constant addition of oilfield material 275 to the fluid line 170 is also achieved. Indeed, carriers of such multiple assemblies may even be powered by the same power supply (such as power supply 300 of FIG. 3).

Figure 3:
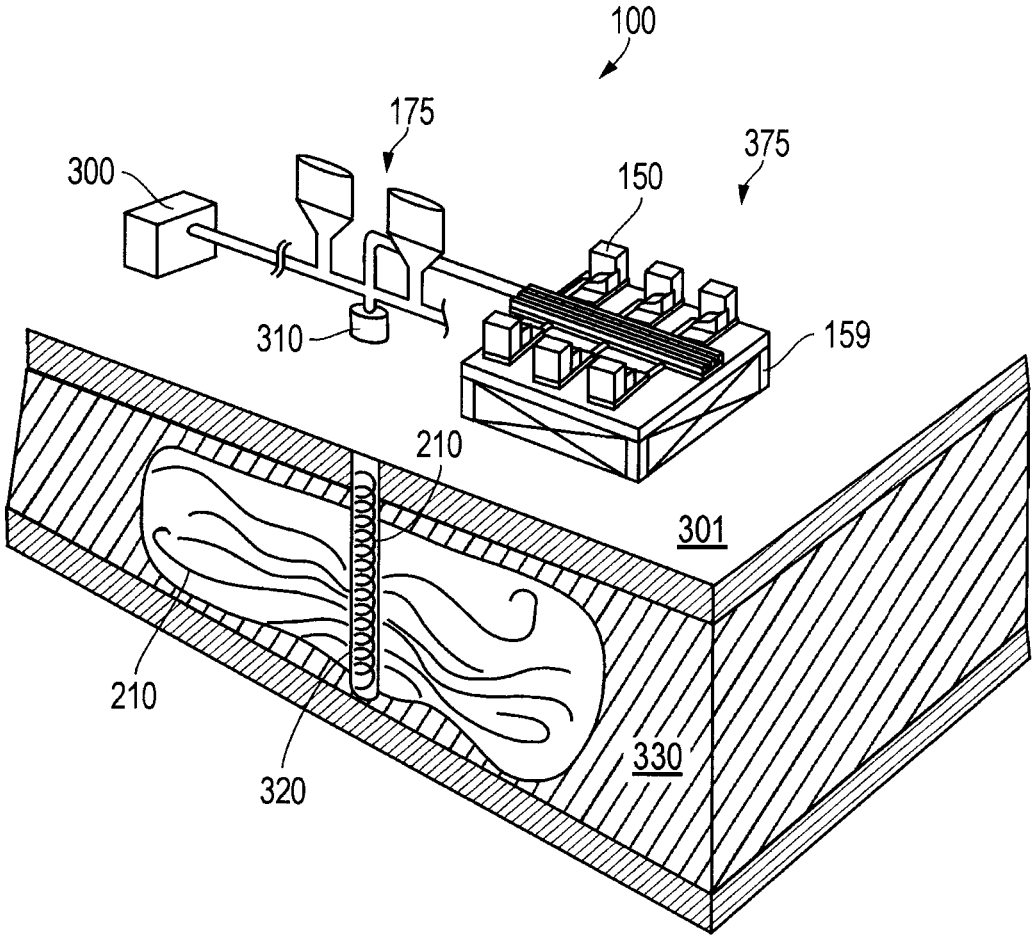
FIG. 3 is a perspective overview of the oilfield material delivery mechanism of FIG. 1 for employment at an oilfield.

Referring now to FIG. 3, with added reference to FIGS. 1 and 2A-2C, an overview of the above described oilfield material delivery mechanism 100 in operation at an oilfield 301 is shown. In the embodiment shown, the oilfield material delivery mechanism 100 is employed in a fracturing operation at the oilfield 301. The pressure inducing equipment 150 of FIG. 1 is a part of a larger pressure inducing assembly 375 including a host of pumps atop the skid 159. A high pressure fluid flow 210 as detailed above with reference to FIGS. 2A-2C, may thereby be generated and directed toward the material supply equipment 175. Reciprocation of the material carrier 201 of this equipment 175 may be achieved by use of a separate power supply 300 at the oilfield. This separate power supply 300 may be in the form of a linear electric motor or a variety of pump types.

Continuing with reference to FIG. 3, the fluid flow 210 is directed past a well head 310 and into a well 320 drilled into the oilfield 301. The well 320 may traverse a fracturable production region 330 of the oilfield 301. The delivery of a high pressure fluid flow 210 may thereby be employed to promote the production of hydrocarbons from the production region 330. That is, as detailed above the fluid flow 210 may include oilfield material 275 in the form of an abrasive proppant to encourage the fracturing of geologic formations below the oilfield 301 in order to enhance the noted hydrocarbon production.

Figure 4:
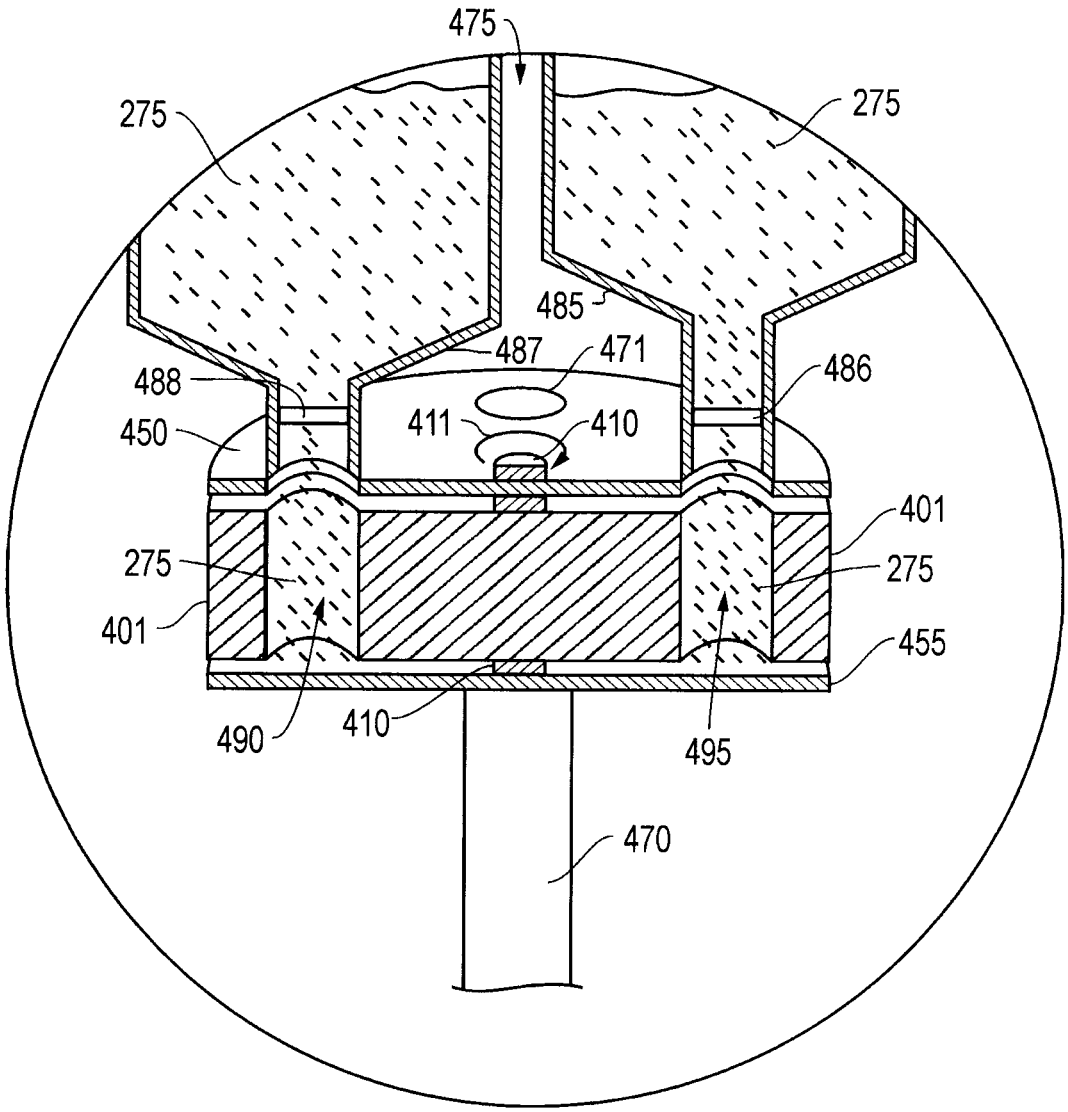
FIG. 4 is a cross-sectional perspective view of an alternate embodiment of material supply equipment for use with an oilfield material delivery mechanism.

Continuing now with reference to FIG. 4, an alternate embodiment of material supply equipment 475 is shown. In this embodiment the material carrier 401 is configured for rotable movement as opposed to the reciprocating nature of the material carrier 201 depicted in FIGS. 2A-2C. The material carrier 401 may again include multiple chambers 490, 495 for filling with oilfield material 275 from multiple reservoirs 485, 487. A rotable hub 410 may be secured to a stationary lower housing plate 455, running upward through the material carrier 401 and to, or perhaps through a stationary upper housing plate 450. The material carrier 401 may be coupled to the hub 410 such that rotation thereof may be employed to drive rotation of the carrier 401, for example, in the direction noted by arrow 411. Rotation of the hub 410 in this manner may be achieved by a belt drive or other conventional powering means coupled to a portion of the hub 410 to effect its rotation.

As depicted in FIG. 4, both valves 486, 488 of both reservoirs 485, 488 are simultaneously open as both chambers 490, 495 of the material carrier 401 are positioned below the reservoirs 485, 488 at the same time. However, in alternate embodiments, the material carrier 401 or synchronization of the valves 486, 488 may be such that only one of the chambers 490, 495 is filled with oilfield material 275 at any given point in time.

Once a chamber 490, 495 is filled with oilfield material 275 as described above, the continued rotation of the material carrier 401 in the direction of the arrow 411 will bring the chambers 490 to traverse a fluid line 470, through which an oilfield fluid flow may be driven similar to that detailed above. For example, the fluid line 470 is depicted in FIG. 4 as exiting below the material supply equipment 475, for example, toward a well 320 such as that depicted in FIG. 3. Similarly, the fluid line 470 may be directed to the material supply equipment 475 from pressure inducing equipment 150 such as that shown in FIG. 1. Indeed, the cross-sectional perspective view of FIG. 4 reveals an upper housing plate orifice 471 for receiving the fluid line 470 from pressure inducing equipment 150 such as that of FIG. 1. Similar to embodiments detailed above, a fluid flow may be driven through this orifice 471 to pick up and transfer oilfield material 275 from the chambers 490, 495 once rotably aligned therewith as described further below.

From the position shown in FIG. 4, rotation of the material carrier 401 may bring the first material filled chamber 490 into intersection with the orifice 471 of the upper housing plate 450. In this manner, a pressurized fluid flow may be driven through the orifice 471 and down the fluid line 470. Thus, for example, an oilfield material 275 in the form of proppant may be provided to a flow of fracturing fluid for a fracturing operation as described above. In fact, the fluid line 470 may be split for intersecting a second orifice (not shown) of the upper housing plate 450 for residing forward of the hub 410 in the depiction shown. In this manner, the second material filled chamber 495 may be emptied into the fluid line 470 at the same time as the emptying of the first chamber 490.

As with embodiments described with reference to FIGS. 2A-2C, the embodiment of FIG. 4 provides a manner by which dirty oilfield material fluid is substantially restricted to a region of the fluid line 470 that resides below the material carrier 401. Thus pressure inducing equipment 150 such as that of FIG. 1 may be spared exposure to abrasive oilfield material 275.

Additionally, the material carrier 401 may deliver oilfield material 275 in a continuous and uninterrupted manner. In fact, to prevent complete occlusion of fluid flow through the fluid line 470 during filling of the chambers 490, 495 as depicted in FIG. 4, the material supply equipment 475 depicted may be served by a separate channel or deviation of the fluid line that is employed for traversing the equipment 475 as described. For example, the separate channel equipment may be of a Venturi or other suitable configuration to divert fluid flow therethrough only upon intersection of orifice 471 and chamber 490, 495. The remainder of the time, fluid flow may proceed without diversion to the equipment 475. Furthermore, like the embodiments of FIGS. 2A-2C, the material supply equipment 475 depicted may be but one of several material supply equipment 475 assemblies coupled to the fluid line 470. Thus, a timed synchronization between such assemblies and rotable material carriers thereof may be utilized to ensure that a constant addition of oilfield material 275 is achieved.

Figure 5:
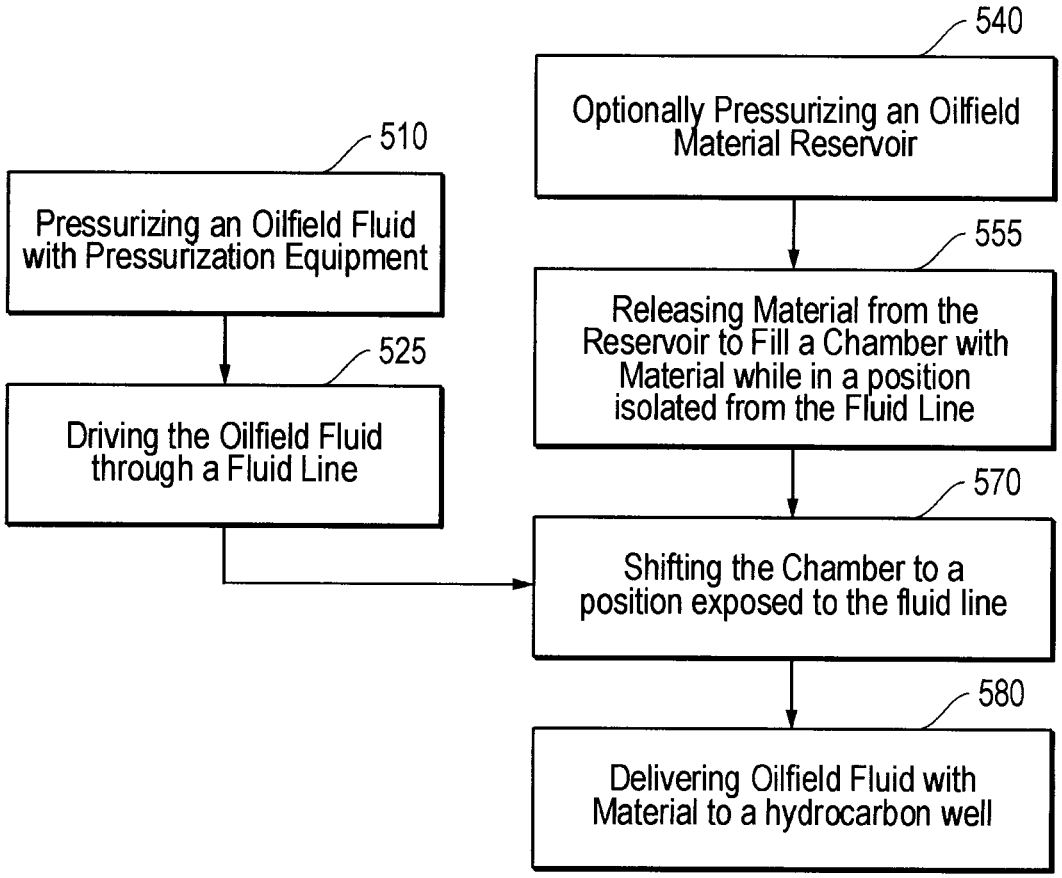
FIG. 5 is a flow-chart summarizing an embodiment of employing an oilfield material delivery mechanism.

Referring now to FIG. 5 a flow-chart is shown summarizing embodiments of employing an oilfield material delivery mechanism as detailed above. Regardless of the particular embodiment of material delivery mechanism employed, an oilfield material is supplied to an oilfield fluid flow from pressure inducing equipment in a manner that maintains substantial isolation of the oilfield material from the equipment at all times.

An oilfield fluid such as water may be pressurized by pressurization equipment as indicated at 510. As noted above, the pressurization equipment may include a conventional triplex pump or a host of other pressure inducing devices. The pressurized fluid is thus driven through a fluid line as indicated at 525 and may eventually reach a chamber as noted at 570. Apart from the pressurization equipment, material supply equipment is included in which an oilfield material reservoir may be pressurized as indicated at 540. As indicated at 555, some of this material may be released from the reservoir and into a chamber that is isolated from the fluid line along with the reservoir. The chamber may then be shifted into a position that is exposed to the fluid line as noted at 570. An oilfield fluid with the material therein may then be delivered to a hydrocarbon well as indicated at 580.

Figure 6:
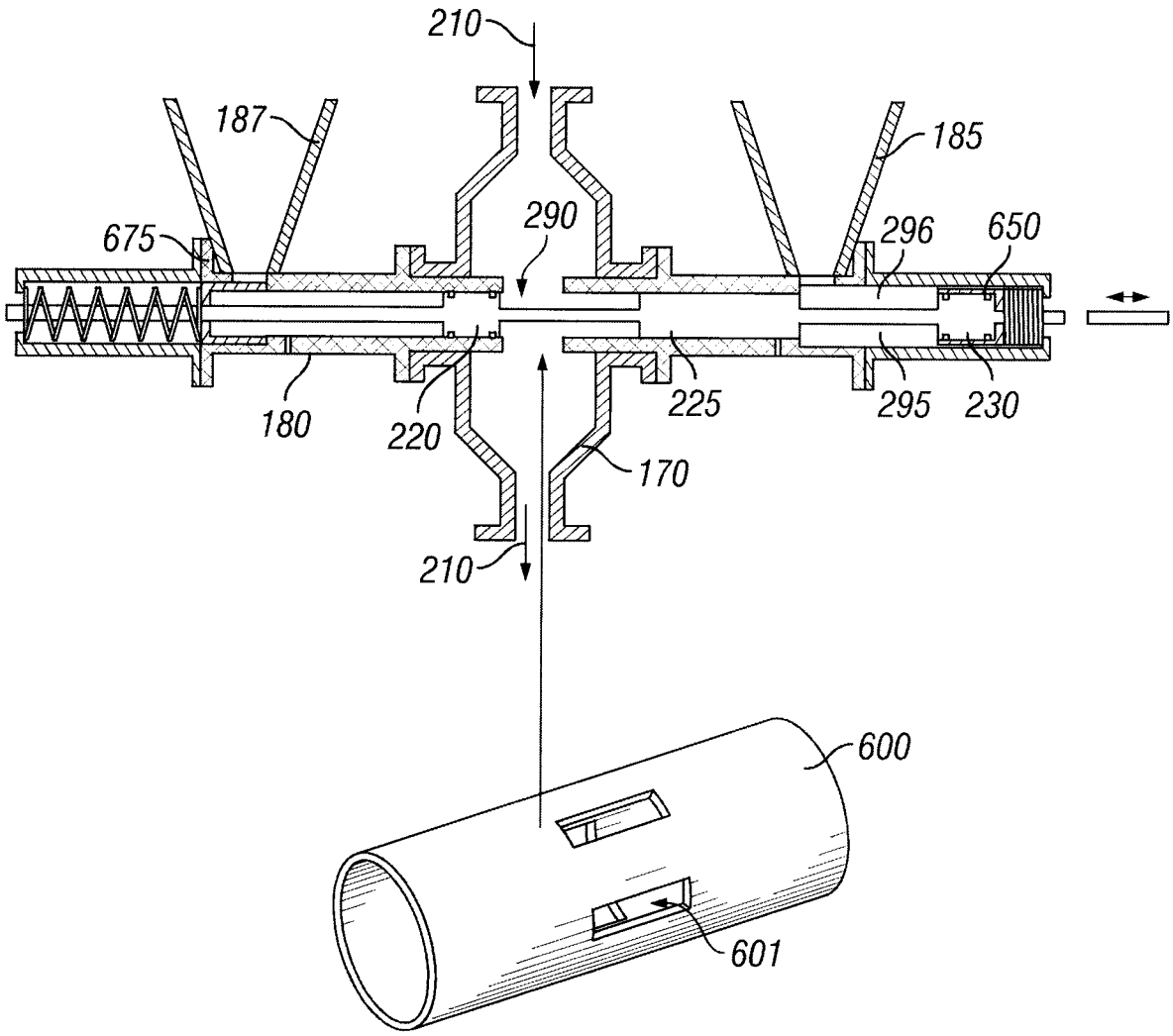
FIG. 6 is a perspective partially sectional view of the oilfield material delivery mechanism of FIG. 1 with abrasive protection features incorporated therein.

Referring now to FIG. 6 a perspective partially sectional view of the oilfield material delivery mechanism of FIG. 1 is depicted with added abrasive protection features 600, 650, 675 incorporated therein. That is, over time, seals 221, 226, 227, 231 and other features of the material carrier 201 may be susceptible to fatigue due to exposure to the oilfield material 275. Therefore, as described below, certain abrasive protection features 600, 650, 675 may be employed to help minimize exposure to the oilfield material 275.

Continuing with reference to FIG. 6, with added reference to FIG. 1, a bore 600 with slots 601 therein may be employed about the separators 291, 296. In this manner a more continuous outer profile of the material carrier 201 may be maintained at the chambers 290, 295. Thus, oilfield material 275 deposited within the chambers 290, 295 would be more likely to remain therein during reciprocation of the material carrier 201 as opposed to being tossed about, perhaps toward seals 221, 226, 227, 231 or space between the carrier 201 and the carrier housing 180. In fact, with particular emphasis on avoidance of oilfield material exposure to carrier portions 220, 230 and seals thereof, retractable sleeves 650, 675 may be provided in order to ensure occlusion of the material reservoirs 185, 187 whenever a respective carrier portion 220, 230 is positioned therebelow. That is, as depicted in FIG. 6, the sleeves 650, 675 may be employed to occlude the reservoirs 185, 187, and only moved to open the reservoirs 185, 187 upon receiving and protectively encompassing a respective carrier portion 220, 230. Thus, each carrier portion 220, 230 may be protectively surrounded by a sleeve 650, 675 in the process of opening each reservoir 185, 187. Therefore, exposure of the carrier portions 220, 230 and seals thereof to oilfield material 275, may be substantially eliminated. Furthermore, the sleeves 650, 675 may be spring biased such that travel by a carrier portion 220, 230 back toward an open reservoir 185, 187 occurs in conjunction with the respective sleeve 650, 675 in an encapsulated and protected manner (until the reservoir 185, 187 is once again safely occluded thereby).

As opposed to merely monitoring some degree of damage to pump equipment, embodiments described herein may actually be employed to minimize the deleterious effects of harsh abrasive oilfield materials on such equipment. Furthermore, the described embodiments minimize exposure of pressurization equipment to potentially damaging materials without requiring a significant amount of additional susceptible equipment and components to the delivery process. Indeed the delivery process itself is such that equipment employed in the delivery of the oilfield material are subjected to a substantially reduced level of fatigue-inducing conditions in achieving the material delivery. Indeed, the need for sophisticated monitoring of the delivery equipment for oilfield material damage thereto during operation is substantially non-existent.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, positive displacement triplex pumps have been described above as the pressure inducing equipment employed. However, other types of pressure inducing equipment such as multistage centrifugal pumps, progressing cavity pumps, plunger pumps, and others may be employed according to embodiments detailed herein. Furthermore, the pressure inducing equipment may be employed in a clean side/dirty side pumping system such as any of the pumping systems described in U.S. patent application Ser. No. 11/754,776, entitled, Split Stream Pumping System, filed on May 29, 2007. In another example, a fracturing application has been detailed in describing the embodiments of the oilfield material delivery mechanism. However, other types of applications may take advantage of such a mechanism. For example, applications may be employ an oilfield fluid that is a low density cement to which oilfield material of additional cement or other cement additives are provided by an embodiment of an oilfield material delivery mechanism as detailed herein. Thus, the foregoing description should not be read as pertaining only to the precise structures described and shown in the accompanying drawings, but rather should be read as consistent with and as support for the following claims, which are to have their fullest and fairest scope.

We claim:

1. An oilfield material supply assembly comprising:

a carrier housing coupled to a fluid line for carrying a fluid flow from a pressure inducing mechanism;

a material carrier disposed within said carrier housing and having a chamber to accommodate an oilfield material;

a material reservoir for housing a supply of the oilfield material, said material reservoir coupled to said carrier housing, the chamber for shifting from a first position to a second position, the first position substantially isolated from the fluid flow and aligned with said material reservoir for allowing the chamber to receive oilfield material therefrom, the second position exposed to the fluid flow; and a retractable sleeve disposed within said carrier housing, wherein said retractable sleeve is capable of moving from a first position that occludes the reservoir to a second position that opens the reservoir and allows the chamber to receive oilfield material;

wherein the material carrier further comprises at least one carrier seal adapted for shifting from the first position to the second position, and the at least one carrier seal adapted for substantially isolating the chamber from the fluid flow pressure in the first position.

2. The oilfield material supply assembly of claim 1 wherein the chamber is a first chamber, said material carrier having a second chamber to accommodate oilfield material.

3. The oilfield material supply assembly of claim 2 wherein said material reservoir is a first material reservoir and the supply is a first supply, the oilfield material supply assembly further comprising:

a second material reservoir for housing a second supply of the oilfield material;

a first reservoir valve disposed within said first material reservoir for the allowing; and a second reservoir valve disposed within said second material reservoir to regulate release of oilfield material from a second supply of the oilfield material within said second material reservoir.

4. The oilfield material supply assembly of claim 3 wherein the shifting is achieved through rotating said material carrier.

5. The oilfield material supply assembly of claim 4 further comprising a rotable hub coupled to said material carrier for the rotating, said carrier housing further comprising:

a stationary upper housing plate coupled to said rotable hub; and a stationary lower housing plate coupled to said rotable hub, said material carrier disposed between said upper housing plate and said lower housing plate.

6. The oilfield material supply assembly of claim 5 wherein the second chamber is positioned for receiving oilfield material from said second material reservoir during the allowing.

7. The oilfield material supply assembly of claim 5 wherein the second chamber is exposed to the fluid flow upon shifting of the first chamber to the second position.

8. The oilfield material supply assembly of claim 5 wherein said carrier housing is coupled to a separate channel of the fluid line to substantially avoid occlusion thereof.

9. The oilfield material supply assembly of claim 8 wherein the separate channel is of a Venturi configuration.

10. The oilfield material supply assembly of claim 1 wherein said chamber is circumferentially defined by a slotted bore.

11. The oilfield material supply assembly of claim 1 wherein the material reservoir is pressurized above atmospheric pressure to actively and readily fill the chamber.

12. The oilfield material supply assembly of claim 1 wherein the shifting is achieved through reciprocating said material carrier.

13. The oilfield material supply assembly of claim 1 wherein said carrier housing is smaller in diameter than the fluid line to avoid occlusion of the fluid flow.

14. The oilfield material supply assembly of claim 1 wherein the oilfield material is selected from the group consisting of sand, ceramic material, cement slurry and a bauxite mixture.

15. The oilfield material supply assembly of claim 1 wherein the retractable sleeve disposed within said carrier housing surrounds the material carrier.

16. The oilfield material supply assembly of claim 1 wherein the retractable sleeve disposed within said carrier housing is spring biased.

17. The oilfield material supply assembly of claim 1 wherein said retractable sleeve is capable of protecting said at least one carrier seal from exposure to the oilfield material.

18. The oilfield material supply assembly of claim 1 wherein said at least one carrier seal are of a material selected from a group consisting of a ceramic, a polymer, and grease.

19. A method of delivering a material to a high pressure flow of fluid, the method comprising:

providing a reservoir of the material;

filling a chamber in a first position with the material from the reservoir in alignment with the first position, wherein the reservoir is substantially isolated from the high pressure flow of fluid;

shifting the chamber from the first position to a second position, the second position exposed to the high pressure flow to the substantial exclusion of the supply; and retracting a sleeve that occludes the reservoir to open the reservoir, the sleeve being disposed within a carrier housing coupled to a fluid line for carrying the fluid flow, and wherein the sleeve being capable of protecting said at least one carrier seal from exposure to the oilfield material;

wherein the chamber is accommodated by a material carrier, said material carrier comprising at least one carrier seal adapted for shifting from the first position to the second position, and the at least one carrier seal adapted for substantially isolating the chamber from the fluid flow pressure in the first position.

20. The method of claim 19 further comprising:

pressurizing the reservoir of the material above atmospheric pressure;

pressurizing the fluid; and driving the fluid through a fluid line to channel the high pressure flow thereof.

21. The method of claim 19 wherein said shifting further comprising one of reciprocating the material carrier and rotating the material carrier.

22. The method of claim 19 further comprising delivering the material to a hydrocarbon well for one of a fracturing operation, water jet cutting, and cementing.

23. An oilfield material delivery mechanism comprising:

a pressure inducing assembly;

a fluid line coupled to said pressure inducing assembly to carry a fluid flow therefrom;

a plurality of material supply assemblies coupled to said fluid line, wherein each material supply assembly comprises:

a material reservoir for housing a supply of the oilfield material, said material reservoir coupled to said fluid line; and a material carrier to accommodate a chamber for shifting from a first position to a second position, the first position substantially isolated from the fluid flow and for allowing the chamber to receive oilfield material from the material reservoir, the second position exposed to the fluid flow to the substantial exclusion of the material reservoir;

wherein the material carrier further comprising at least one carrier seal adapted for shifting from the first position to the second position, and the at least one carrier seal adapted for substantially isolating the chamber from the fluid flow pressure in the first position; and a retractable sleeve disposed within said fluid line, wherein said retractable sleeve is capable of moving from a first position that occludes the material reservoir to a second position that opens the material reservoir and allows the chamber to receive oilfield material, and wherein said retractable sleeve is capable of protecting the at least one carrier seal from exposure to the oilfield material;

wherein the plurality of material supply assemblies operate in a timed synchronization manner so that a continuous and uninterrupted addition of oilfield material to the fluid line can be achieved.

24. The oilfield material delivery mechanism of claim 23 wherein said pressure inducing assembly comprises one of a triplex pump, a multi-stage centrifugal pump, and a progressing cavity pump.

25. The oilfield material delivery mechanism of claim 23 wherein said fluid line terminates at a hydrocarbon well.

26. The oilfield material delivery mechanism of claim 21 wherein the fluid flow includes one of water, a supercritical fluid, and a liquefied gas.

27. The oilfield material delivery mechanism of claim 23 wherein the retractable sleeve disposed within said fluid line is adapted to surround the material carrier.

28. The oilfield material delivery mechanism of claim 23 wherein the retractable sleeve disposed within said fluid line is spring biased.

29. The oilfield material delivery mechanism of claim 23 wherein the material reservoir is pressurized above atmospheric pressure.

* * * * *